US007210685B2

(12) United States Patent
Cheng

(10) Patent No.: US 7,210,685 B2
(45) Date of Patent: May 1, 2007

(54) SPORTING GOOD STRUCTURE

(75) Inventor: Sen-Mei Cheng, Changhua Hsien (TW)

(73) Assignee: Taiwan Paiho Limited, Changhua Hsien (TW)

( * ) Notice: Subject to any disclaimer, the term of this patent is extended or adjusted under 35 U.S.C. 154(b) by 0 days.

(21) Appl. No.: 10/952,861

(22) Filed: Sep. 30, 2004

(65) Prior Publication Data

US 2006/0033283 A1 Feb. 16, 2006

(30) Foreign Application Priority Data

Aug. 16, 2004 (TR) ..... 93213028 U

(51) Int. Cl.
*A63B 63/00* (2006.01)

(52) U.S. Cl. ..... 273/348.4; 473/193; 273/350

(58) Field of Classification Search ..... 273/348.4, 273/348.2, 350, 348.3, 398–402, 348.5; 473/197
See application file for complete search history.

(56) References Cited

U.S. PATENT DOCUMENTS 3,350,097 A * 10/1967 Chevrette et al. ..... 273/350
5,088,740 A * 2/1992 Peterson ..... 273/410
5,344,155 A * 9/1994 Huang ..... 273/348.4
5,358,742 A * 10/1994 Ziff ..... 427/276
5,549,302 A * 8/1996 Lapsker et al. ..... 473/416
5,570,889 A * 11/1996 Tyrer ..... 273/348.4
5,603,504 A * 2/1997 Powell ..... 273/348.4
5,626,342 A * 5/1997 Foster ..... 273/348.4
6,089,570 A * 7/2000 Gruber ..... 273/348.4
2002/0183127 A1* 12/2002 Cho ..... 473/197

* cited by examiner

*Primary Examiner*—Mark S. Graham
(74) *Attorney, Agent, or Firm*—Troxell Law Office, PLLC

(57) ABSTRACT

A sporting good structure including a frame and a target board with resilient straps attached at four lateral edges and being led and joined to a bracket unit of the frame so as to locate the target board onto the frame. The target board has a transparent hook side corresponding with a fleeced stick side of a sporting device such as a ball. The transparent hook side is mutually combined with a patterned layer with diagrams visible through the transparent hook side to provide a perspective visual effect. An outer surface of the patterned layer is coated with a protective film. When the sporting device hits onto the target board thereof, the resilient straps will be elastically stretched according to the impact generated providing an anti-shock effect for the sporting device to grip onto the transparent hook side of the target board in a secure manner. The diagram disposed at the patterned layer of the target board can also have various sporting backgrounds.

6 Claims, 4 Drawing Sheets

SPORTING GOOD STRUCTURE

BACKGROUND OF THE INVENTION

1. Field of the Invention

The present invention relates to a sporting good structure, including a frame and a target board with resilient straps attached to four lateral edges thereof to mount the target board onto the frame. The target board is provided with a transparent hook side corresponding with a fleeced stick side for a sport device like a ball of different sports. The transparent hook side is mutually combined with a patterned layer with diagrams that can be clearly seen through the transparent hook side. Therefore, when the sport device hits onto the target board, the resilient straps provide an anti-shock effect for the sporting device to grip securely onto the transparent hook side. Besides, the diagrams disposed on the patterned layer of the target board can also be made as various sporting backgrounds to fit to the interest of different users, facilitating a more widespread use as well as providing a realistic visual effect to boost the quality of leisure sports.

2. Description of the Prior Art

A conventional sporting good structure, as shown in FIG. 1, is made up of a catching board 10 and a sleeve grip 11 attached at one side of the catching board. The catching board 10 is also equipped with a hook side 12 with a plurality of protrusive fastener dots 121 disposed on a surface corresponding with a fleeced stick surface 131 of a ball 13 In practical use, the catching board 10 is held in a hand with the sleeve grip 11 worn around a palm to catch the ball 13 tossed onto the catching board 10 and permitting the fleeced stick surface 131 to grip onto the hook side 12 when touching the catching board 10 in a toss-and-catch process.

There are some drawbacks to the conventional sporting good. First, the catching board 10 does not provide any anti-shock effect. Thus, when tossed, the ball 13 can easily bounce backwards due to an impact generated when the ball 13 bumps onto the catching board 10. The fleeced stick surface 131 of the ball 13 is hard to grip accurately onto the hook side 12 of the catching board 10 and can easily come off and fall onto the ground, which tends to reduce the interest of a user. Second, the hook side 12 of the catching board 10 is plainly designed with a solid color without any diagrams of various sporting backgrounds such as soccer, baseball, or golf, etc. disposed thereon, which, failing to provide a realistic visual effect and rendering it rather limited in practical use and thus uncompetitive in the market.

SUMMARY OF THE INVENTION

The primary purpose of the present invention is to provide a sporting good structure, including a frame and a target board with resilient straps attached to four lateral edges thereof to mount the target board onto the frame. The target board is provided with a transparent hook side matching with a fleeced stick side of a sporting device like a ball of different sports. Therefore, when the sporting device hits the target board, the resilient straps will be elastically stretched according to the impact generated by the sporting device to provide an anti-shock effect for the sporting device to accurately grip onto the transparent hook side of the target board in a secure manner, efficiently boosting the interest in the sport achieving the base using condition thereof.

The second purpose of the present invention is to provide a sporting good structure wherein the transparent hook side is mutually combined with a patterned layer with diagrams thereon that can be clearly seen through the transparent hook side. The diagrams disposed on the patterned layer of the target board can also be made as various sporting backgrounds so as to fit to the interest of different users, facilitating a more widespread use of the product, as well as providing a realistic visual effect to boost the quality of leisure sports.

DETAILED DESCRIPTION OF THE PREFERRED EMBODIMENTS

Figure 1:
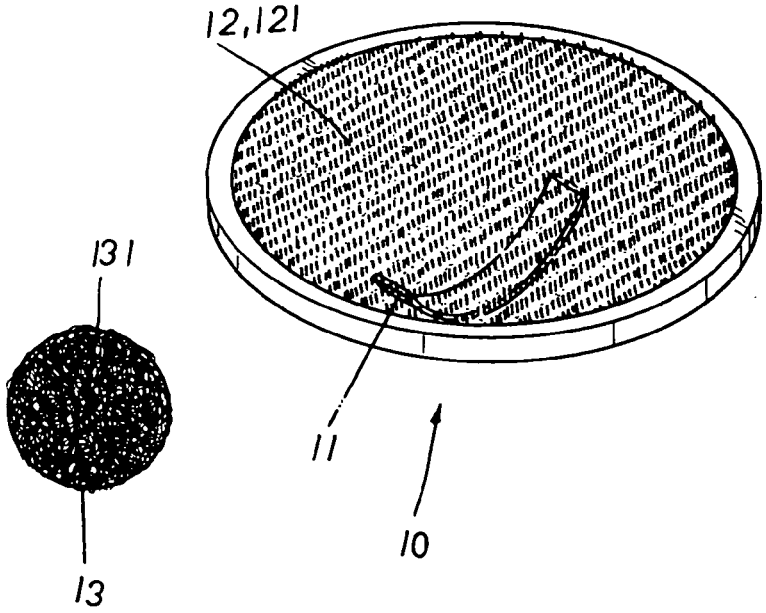
FIG. 1 PRIOR ART
FIG. 1 is a perspective view of a conventional sporting good structure.
Figure 4:
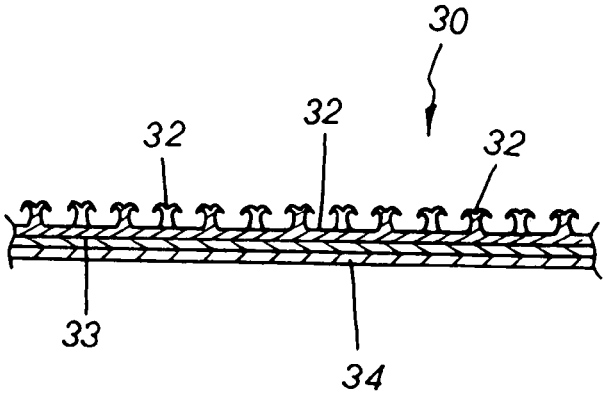
FIG. 4 is a partially enlarged and cross sectional view of a target board of the present invention.
Figure 2:
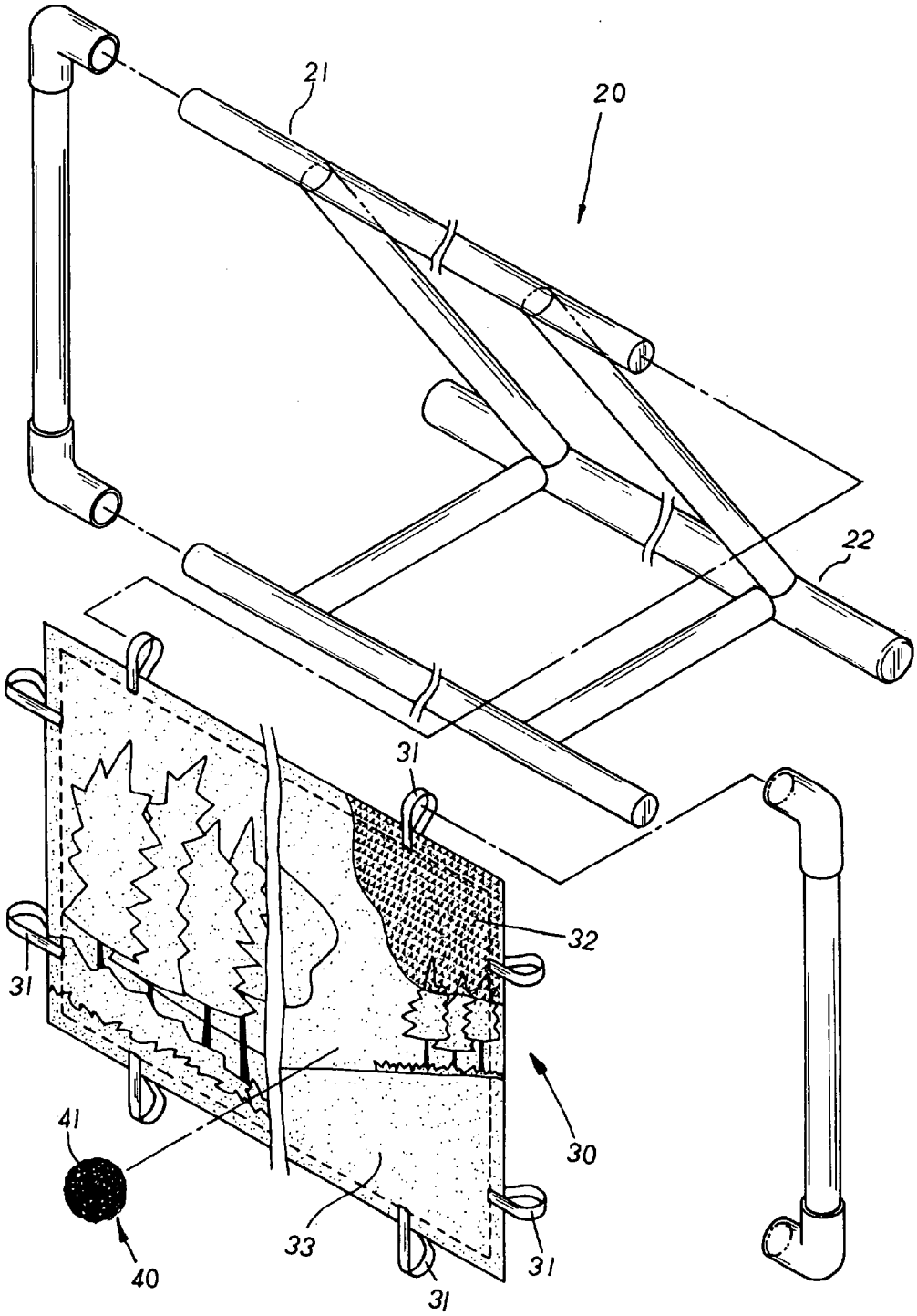
FIG. 2 is a perspective exploded view of the present invention.
Figure 3:
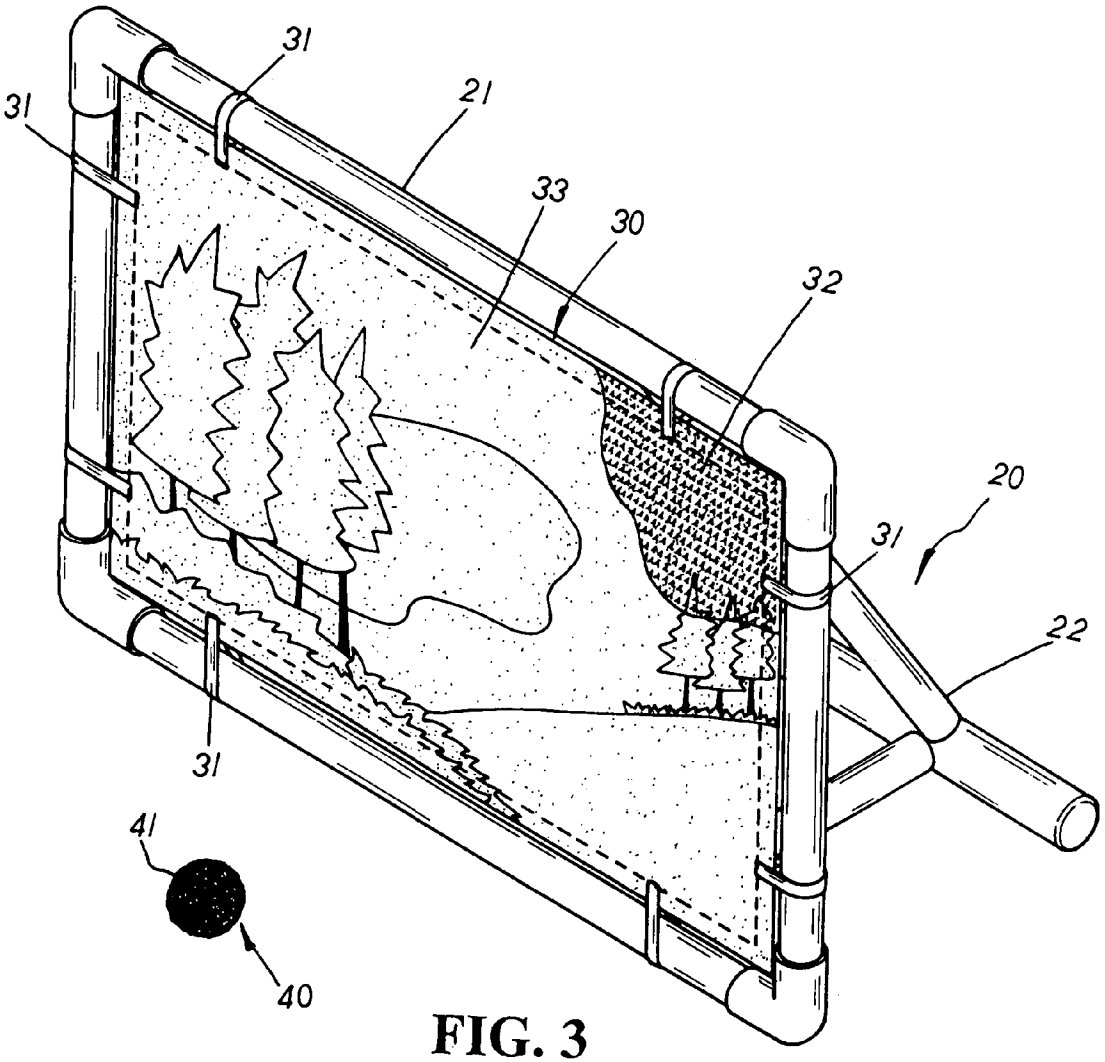
FIG. 3 is a perspective view of the present invention in assembly.

As illustrated in FIGS. 2 and 2, the present invention is related to a sporting good structure including a frame 20 having a bracket unit 21 and a support rack 22 fixedly mounted at one side of the bracket unit 21 thereof, and a target board 30 with resilient straps 31 attached to four lateral edges thereof to be led and joined to the bracket unit 21 so as to locate the target board 30 onto the frame 20. The target board 30 has a transparent hook side 32 with consecutive and transparent protrusive fastener hooks lined thereon and corresponding with a fleeced stick side 41 of a sporting device 40 shaped like a golf ball, soccer ball, or a baseball, etc. The transparent hook side 32 is mutually combined with a screen-printed patterned layer 33 whose diagrams can be made into versatile sporting backgrounds such as a golf court, a baseball diamond, or a soccer field, etc. and can be clearly seen through the transparent hook side 32 thereof to provide a realistic visual effect. In addition, the patterned layer 33 is coated with a protective film 34 on an outer surface as shown in FIG. 4.

In practical use, the resilient strap 31 attached at the four lateral edges of the target board 30 connected with the bracket unit 21 of the frame 20 can absorb the impact produced by the sporting device 40, such as versatile balls, tossed at the target board 30. When the sporting device 40 hits the target board 30, the resilient straps 31 will be elastically stretched according to the impact generated by a throwing speed thereof to provide an anti-shock effect. Therefore, the fleeced stick side 41 of the sporting device 40 can directly and accurately grip onto the transparent hook side 32 fo the target board 30 in a secure manner, efficiently boosting the interest in the sport so as to achieve the best using condition thereof. And, via the transparent hook side 32 of the target board 30, the diagrams disposed on the patterned layer 33 can be seen there-through to provide a perspective visual effect. Besides, the patterned layer 33 of the target board 30 can also be variously designed with diagrams of versatile sporting backgrounds so as to fit to the interest of different users, facilitating a more widespread use of the structure, as well as providing a realistic visual effect to boost the quality of leisure sports.

Figure 5:
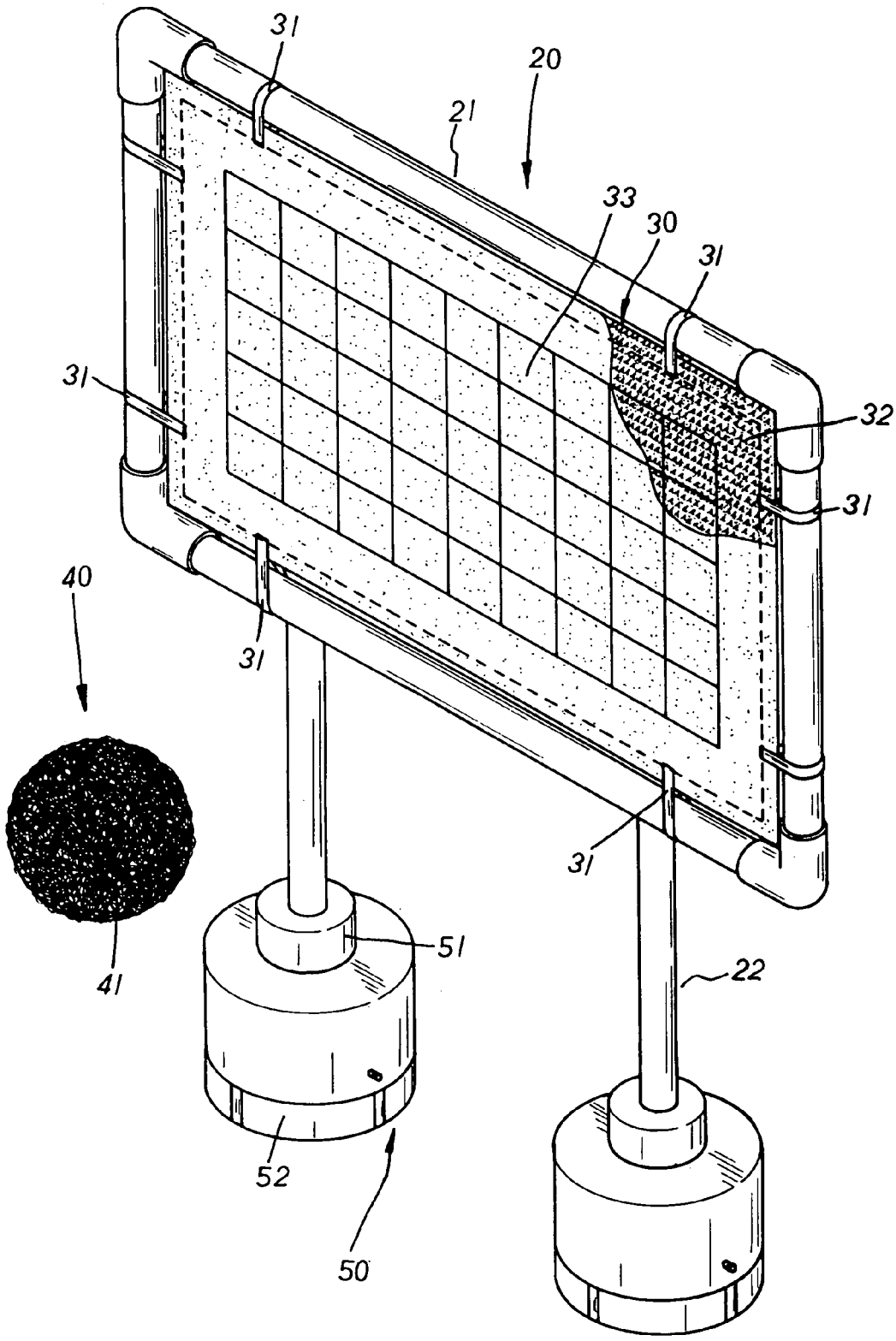
FIG. 5 is a perspective view of another embodiment of the present invention in assembly.

In FIG. 5, the present invention can also include a frame 20 having support racks 22 formed in post-like shapes and securely fixed at the bottom side of the bracket unit 21 of the frame 20. The support racks 22 are respectively inserted to a support tube 51 of an inflatable footing base 50 that is capable of floating on water. A counterweight 52 is fixed to a bottom of the footing base 50, permitting the frame 20 to stand upright and float on the surface of the water. The patterned layer 33 of the target 30 can also be changed in diagrams to fit to the background of water sports accordingly.

What is claimed is:

1. A sporting good structure comprising: a frame and a target board having a plurality of resilient straps attached to four lateral edges thereof, the plurality of resilient straps are connected to a bracket unit of the frame locating the target board on the frame, the target board has a transparent hook side connected to a fleeced stick side thereof, the transparent hook side is combined with a patterned layer having diagrams representing at least one sport located thereon and being visible through the transparent hook side, the patterned layer is coated with a protective film on an outer surface thereof, wherein, when a sporting device hits the target board, the resilient straps are elastically stretched according to an impact generated by a throwing speed thereof to provide an anti-shock effect, and a fleeced stick side of the sporting device removably gripping the transparent hook side of the target board.

2. THE sporting good structure according to claim 1, wherein the transparent hook side of the target board is provided with consecutive and transparent protrusive fastener hooks located on a surface thereof.

3. The sporting good structure according to claim 1, wherein a bracket unit of the frame thereof has a support rack securely fixed at one side thereof.

4. The sporting good structure according to claim 1, wherein the patterned layer of the target board is screen-printed with diagrams.

5. The sporing good structure according to claim 1, wherein the patterned layer of the target board is designed with diagrams of various sporting backgrounds according to different kinds of sports.

6. The sporting good structure according to claim 1, further comprising a inflatable footing base, the frame has a support rack connected to a support tube of the inflatable footing base, the support rack has a post shape, the inflatable footing base is capable of floating on water, and a counterweight is fixed to a bottom of the inflatable footing base permitting the frame to stand upright and afloat on the surface of water.

* * * * *